United States Patent [19]

Quinn

[11] Patent Number: 4,878,334

[45] Date of Patent: Nov. 7, 1989

[54] METHOD OF PACKAGING A DESK

[75] Inventor: Daniel M. Quinn, Chino, Calif.

[73] Assignee: American Wholesale Packaging, Inc., Burbank, Calif.

[21] Appl. No.: 279,204

[22] Filed: Dec. 2, 1988

[51] Int. Cl.[4] ..... B65B 67/00

[52] U.S. Cl. ..... 53/399; 53/592

[58] Field of Search ..... 53/399, 397, 592, 589, 53/590, 582, 580; 493/89, 968, 964

[56] References Cited

U.S. PATENT DOCUMENTS

| | | | |
|---|---|---|---|
| 2,664,813 | 1/1954 | Rose | 53/592 X |
| 3,003,296 | 10/1961 | Feldkamp et al. | 53/399 |
| 4,265,069 | 5/1981 | Heaney | 53/399 |
| 4,799,350 | 1/1989 | Rias | 53/399 |

FOREIGN PATENT DOCUMENTS

| | | | |
|---|---|---|---|
| 0037188 | 3/1977 | Japan | 53/399 |
| 273704 | 9/1970 | U.S.S.R. | 53/399 |

OTHER PUBLICATIONS

Sketch with Fig. A (Showing a Packaged Filing Cabinet) and Fig. B (Showing a Filing Cabinet That is not Packaged), (See by Apllicant Nov., 1987).

Laminations Vboard Brochure (Neenah, WI), (No Date).

Polychem Corp., Econoband Strapping Brochure (Mentor, Ohio), (No Date).

Brochure For Fromm Model P300 Electric Plastic Strapping Tool, (No Date).

*Primary Examiner*—James F. Coan

*Attorney, Agent, or Firm*—Blakely, Sokoloff, Taylor & Zafman

[57] ABSTRACT

A method for packaging a desk is described. The top, front, back, left side, and right side of the desk is covered with a plastic bag. A cord is placed around the top, front, bottom, and rear of the desk. A plurality of front and rear horizontal V-shaped cardboard strips are placed under the cord and onto the edges of the desk residing under the cord. The front and rear horizontal V-shaped cardboard strips are strapped in place. A cord is placed around the left-side, top, right side, and bottom of the desk. A plurality of side horizontal V-shaped cardboard strips are placed under the cord and onto the edges of the desk residing under the cord. The side horizontal V-shaped cardboard strips are strapped in place. A cord is placed around the left side, front, right side, and back of the desk. A plurality of vertical V-shaped cardboard strips are placed under the cord and onto the edges of the desk residing under the cord. The vertical V-shaped cardboard strips are strapped in place.

8 Claims, 10 Drawing Sheets

METHOD OF PACKAGING A DESK

FIELD OF THE INVENTION

The present invention pertains to the field of packaging. More particularly, this invention relates to the packaging of a desk.

BACKGROUND OF THE INVENTION

In the prior art, a desk is typically packaged in a cardboard carton that covers the entire desk. The intent is to have the cardboard carton protect the desk from damage in shipment or storage. Nevertheless, desks stored in cardboard cartons are sometimes damaged during the course of packaging or removal from the carton.

The prior art method for packaging a disk is not done on the production line. Rather, the packaging is done off-line. A finished desk ready for packaging arrives at the end of conveyor in a factory. The desk typically is packaged whenever time is available, usually at the end of a shift. This typically results in costly overtime pay for the workers.

The desk is removed from the conveyor and transported to a separate holding area. The separate holding area has to be relatively large to provide sufficient space for the storage and packaging of desks. In the holding area, a corrugated box is placed on the floor. Bottom flaps for the box are glued by hand using a paint brush. After being glued, the flaps are stapled using an air stapler. A corrugated pallet is placed inside the box. A 2-mil polyurethane bag is placed over the desk. The bag is not a form-fit bag. A corrugated cardboard sheet is placed over the top of the desk for protection.

The desk is manually lifted into the box. A corrugated corner is placed at each corner of the desk for corner protection. The top flaps of the carton are glued closed and then stapled. A 3/8 inch plastic strap is placed around the box in two places with manual tools.

Once the desk arrives at its destination after shipment, the desk is removed from the prior art box by cutting the box with a sharp-edged knife or razor. Either the box is cut completely away or the desk is lifted out of the box once the top of the box is opened. The desk is then removed from the bag.

One disadvantage of the prior art method of packaging a desk is that the packaging is done off the production line in a separate holding area rather than on the production line.

Another disadvantage of the prior art method of packaging is that the method is relatively slow and labor-intensive.

A further disadvantage of the prior art method is that the placing of desks in cardboard containers and the removal of desks from cardboard containers sometimes results in desks being damaged.

Another disadvantage of the prior art method of packaging is that in order to visually inspect a desk for color or damage, for example, the opaque cardboard container in which the desk is packed must be opened.

Another disadvantage of the prior art method of packaging is that the cardboard container takes up a relatively large amount of space around the desk, lessening the number of desks that can be stored in a given volume, such as the back of a truck.

A further disadvantage of the prior art method of packaging is that the packaging materials are bulky and take up relatively large amounts of storage space before the desks are packaged.

In the prior art, a strip of paperboard shaped into a "V" has been used as an edge-protector in packaging pallets of items. An example of such an edge-protector is VBoard available from Laminations company of Neenah, Wisconsin. Prior art edge protectors have been used in conjunction with pallets and strapping to package cartons, can goods, bottle goods, medicines, batteries, books, roll stock, and knocked-down cartons, for example. Edge-protectors have also been used in conjunction with pallets and strapping to stabilize and contain rounded or irregular shapes that do not nest closely together. Edge protectors have also been used in the packaging of loads wrapped in clear stretch-wrap on pallets.

SUMMARY AND OBJECTS OF THE INVENTION

In view of the limitation of known methods of packaging, one of the objectives of the present invention is to provide an improved method for packaging a desk while the desk is still on the production line and without the use of a separate holding area.

Another objective of the present invention is to provide an improved method for packaging a desk that results in less damage to desks during packing or unpacking.

Another objective of the present invention is to provide an improved method for packaging a desk that facilitates the visual inspection of a desk for color, size, or the presence of any damage, for example.

Another objective of the present invention is to provide an improved method for packaging a desk that results in a packaged desk that is only slightly larger than the desk itself, thus minimizing storage space.

These and other objects of the invention are provided for by a method for packaging a desk having a top, bottom, front, back, left side, and right side. The top, front, back left side, and right side of the desk is covered with covering means. A first flexible securing means is placed around the top, front, bottom, and rear of the desk. A plurality of front and rear horizontal edge-protecting means are placed under the securing means and onto the edges of the desk residing under the securing means. The plurality of front and rear horizontal edge-protecting means are strapped in place by strapping around the front and rear horizontal edge-protecting means and around the top, front, bottom, and rear of the desk. A second flexible securing means is placed around the left side, top, right side, and botton of the desk. A plurality of side horizontal edge-protecting means are placed under the securing means and onto the edges of the desk residing under the securing means. The plurality of side horizontal edge-protecting means are strapped in place by strapping around the side horizontal edge-protecting means and around the left side, top, right side, and bottom of the desk. A third flexible securing means is placed around the left side, front, right side, and back of the desk. A plurality of vertical edge-protecting means are placed under the securing means and onto the edges of the desk residing under the securing means. The plurality of vertical edge-protecting means are strapped in place by strapping around the vertical edge-protecting means and around the left side, front, right side, and back of the desk.

Other objects, features, and advantages of the present invention will be apparent from the accompanying drawings and from the detailed description which follows below.

BRIEF DESCRIPTION OF THE DRAWINGS The present invention is illustrated by way of example and not limitation in the figures of the accompanying drawings, in which like references indicate similar elements, and in which.

Figure 9:
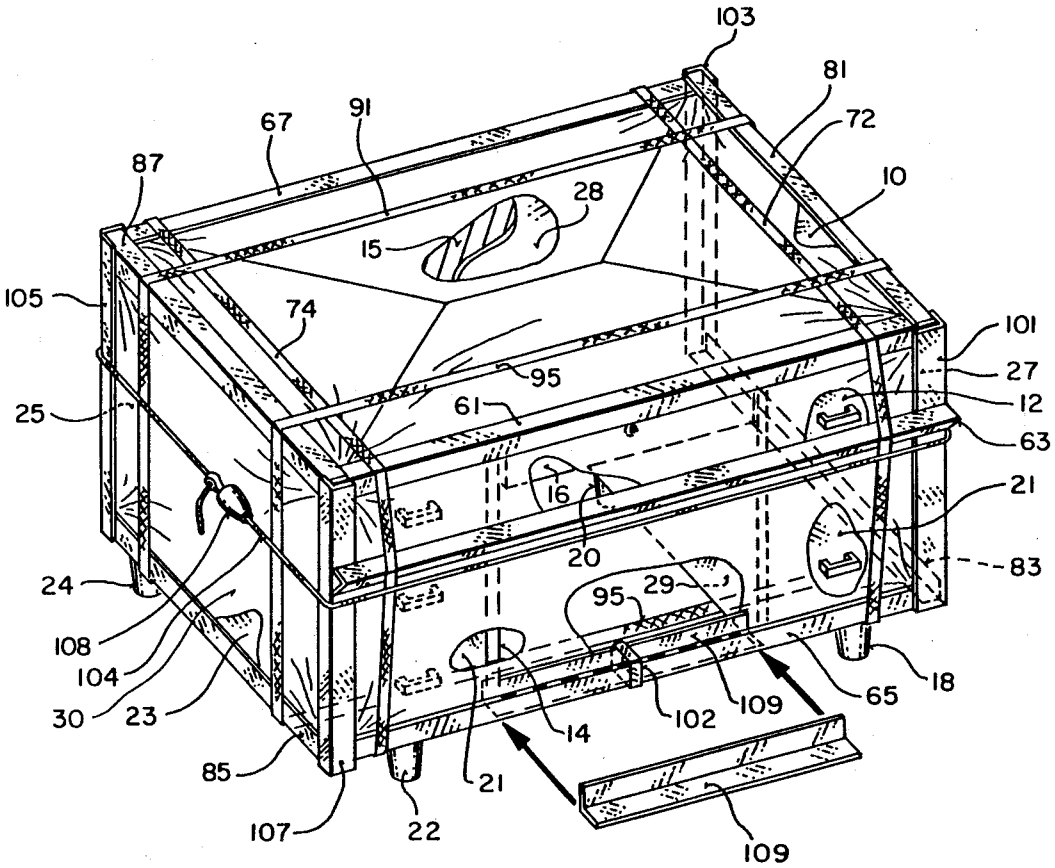
Figure 10:
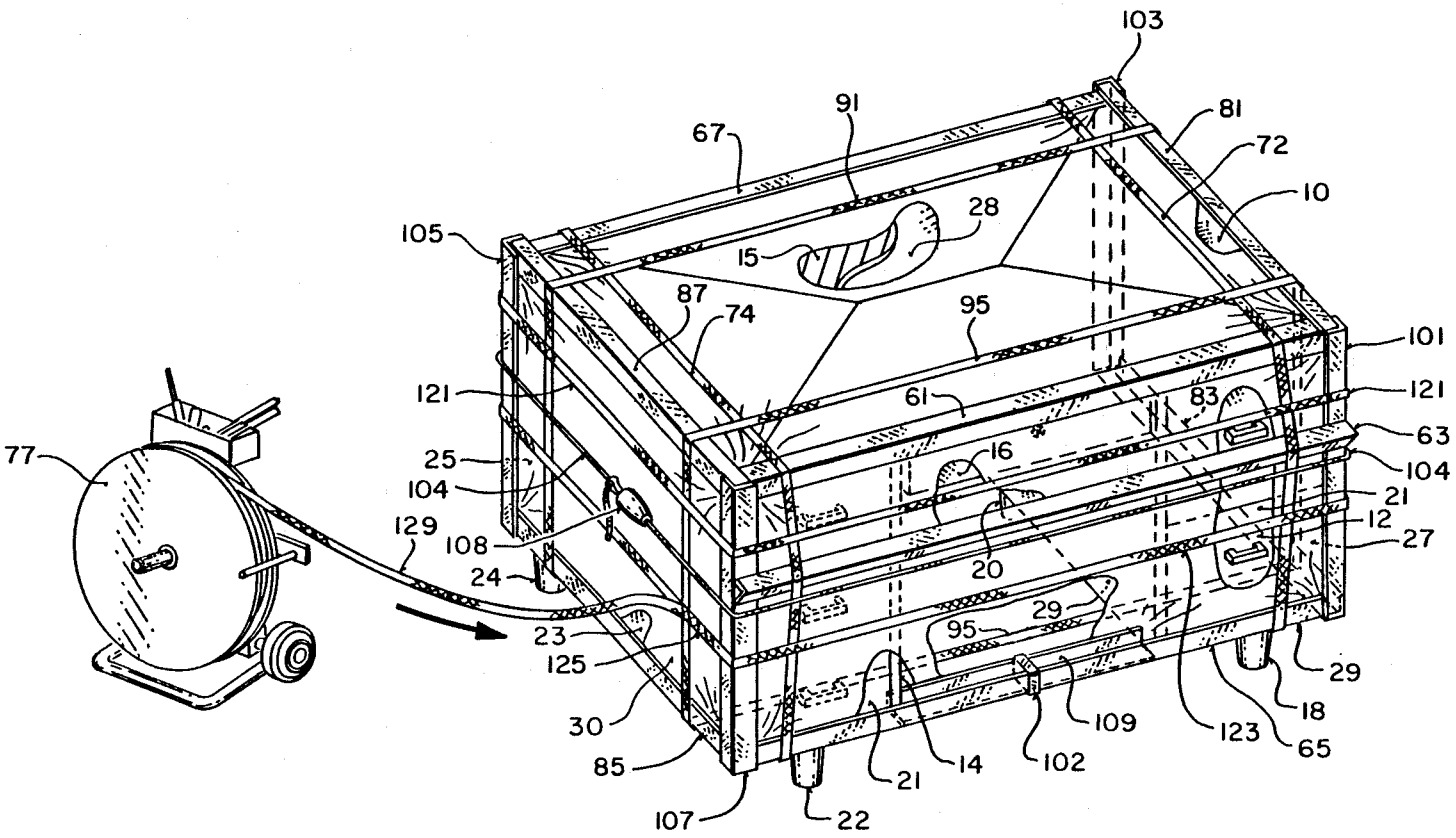

FIG. 9 is a pictorial view of a desk with a cord placed around the left side, front, right side, and back of the desk, and vertical edge-protectors placed under the cord and onto the edges of the desk residing under the cord, and an edge-protector placed between the set of the left drawers and the set of the right drawers of the desk; and FIG. 10 is a pictorial view of a desk with straps placed around the vertical edge-protectors and around the left side, front, right side, and back of the desk.

DETAILED DESCRIPTION

Figure 1:
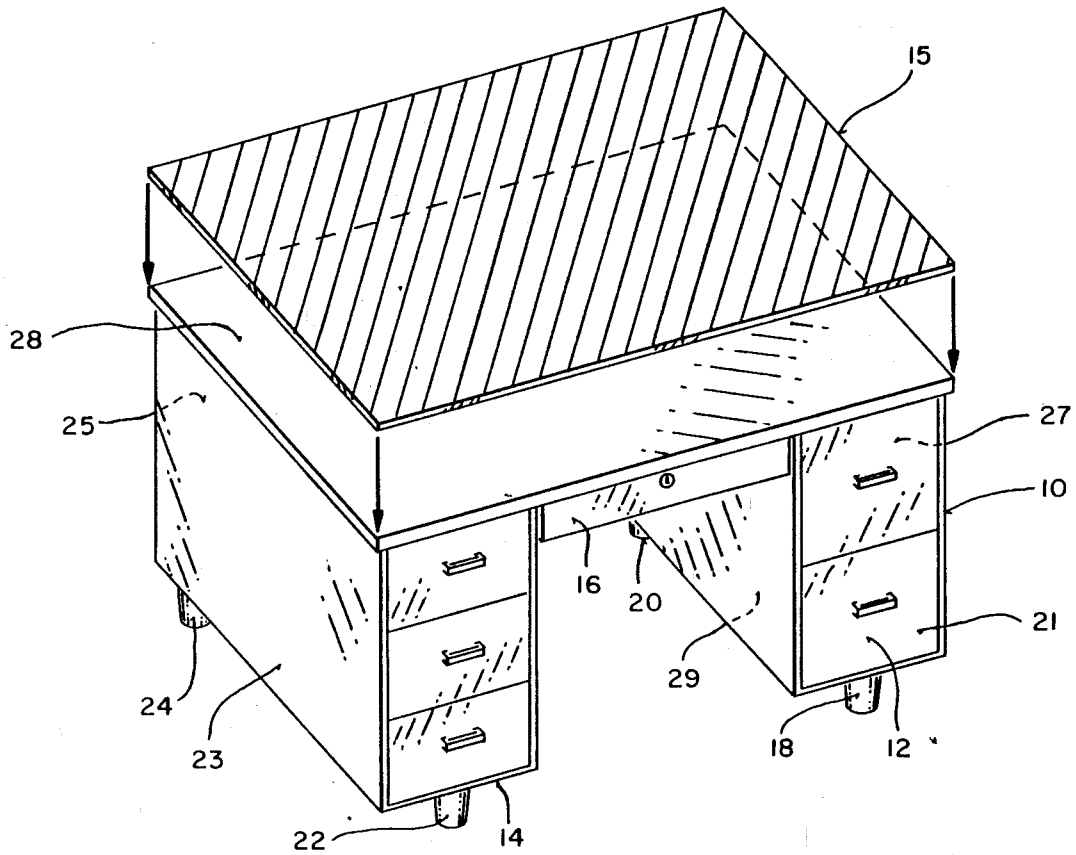
FIG. 1 is a pictorial view of a desk with a pad being placed on the top of the desk.

With reference to the drawings, FIG. 1 illustrates a conventional double pedestal desk 10 with a right set of drawers 12 (also referred to as pedestal 12), a middle drawer 16, and a left set of drawers 14 (also referred to as pedestal 14). Desk 10 has right legs 18 and 20 and left legs 22 and 24 attached to the botom of desk 10. Desk 10 has a front 21, a left side 23, a rear or back 25, a right side 27, a bottom 29, and a top 28.

As part of the preferred method of packaging desk 10, corrugated pad 15 is placed on top 28 of desk 10. Typically, top 28 of a conventional desk 10 is 30 inches deep and 60 inches wide. Top 28 of desk 10 is typically 29 inches from the floor. In a preferred embodiment of the present invention, corrugated pad 15 is a 200 pound-test cardboard pad. Pad 15 helps protect top 28 of desk 10 from damage during storage or shipment.

Figure 2:
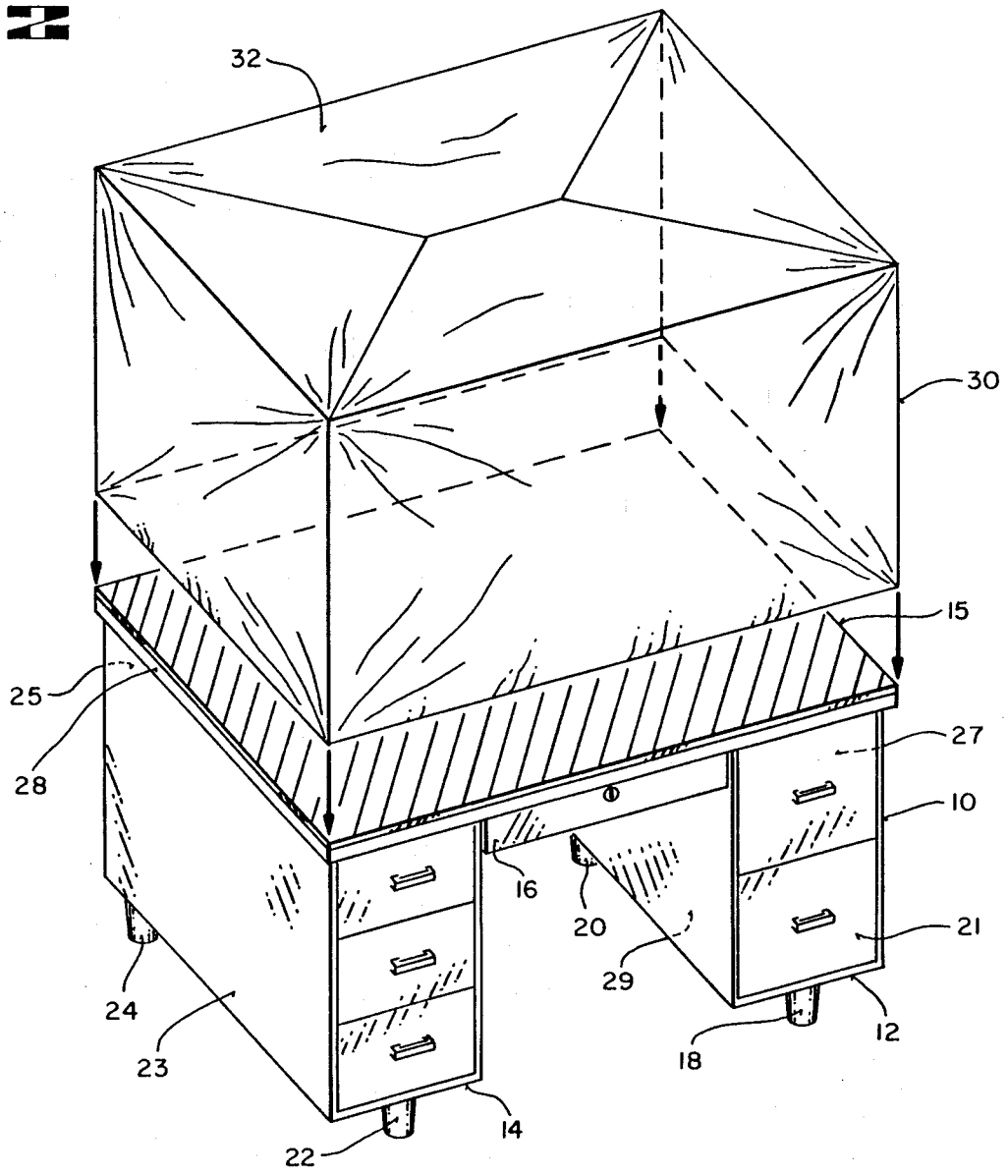
FIG. 2 is a pictorial view of a desk with a bag being placed over the desk.

FIG. 2 illustrates substantially clear polyurethane bag 30 being placed over top 28 and corrugated pad 15 of desk 10. In a preferred embodiment of the present invention, bag 30 is custom or form fitted to fit snugly over desk 30 and drape to the floor. Clear polyurethane bag 30 has a top 32 that covers top 28 and corrugated pad 15 of desk 10. In a preferred embodiment of the present invention, polyurethane bag 30 is 4 mils thick.

Polyurethane bag 30 provides scratch and weather protection for desk 10. Moreover, given that bag 30 is substantially clear, bag 30 allows desk 10 to be substantially observed after packaging is completed. Thus, the color of desk 10, the size of desk 10, and many types of damage to desk 10 can be substantially visible after the packaging of desk 10 is completed.

Figure 3:
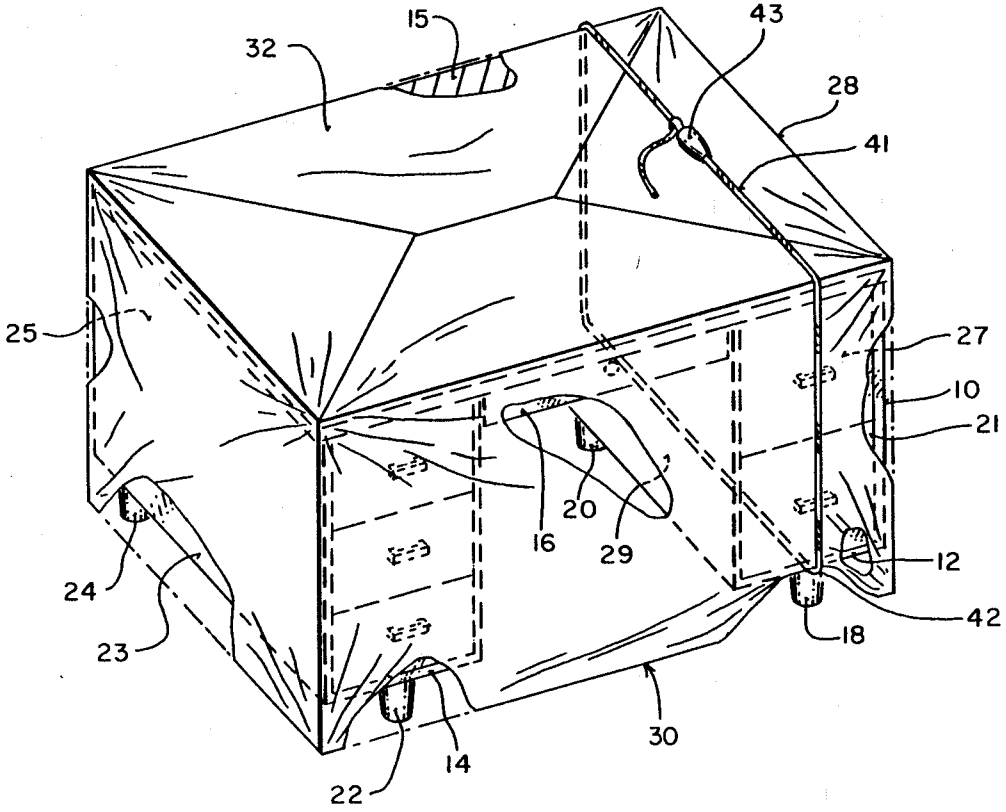
FIG. 3 is a pictorial view of a desk with a cord being placed around the top, front, bottom, and rear of the desk.

FIG. 3 illustrates desk 10 with bundgy cord 41 wrapped around top 28 (and corrugated pad 15), front 21, bottom 29, and rear 25 of desk 10. Bundgy cord 41 is a type of flexible securing cord. In alternative embodiments of the invention, other types of flexible securing cords can be used. Bundgy cord 41 includes a spring loaded clip 43 at the end of bundgy cord 41 for clipping or securing bundgy cord 41. Clip 43 is similar to each of the clips at the end of common battery jumper cables. In alternative embodiments of the present invention, bundgy cord 41 could be fastened in other ways -- for example, by tying the ends of bundgy cord 41 together.

Bundgy cord 41 also resides on the outside of polyurethane bag 30. Given that bundgy cord 41 is wrapped around the front, top, rear, and bottom of desk 10, bundgy cord 41 pulls bag 30 from the floor at point 42 and bag 30 resides under bundgy cord 41 at point 42. In an alternative embodiment of the present invention, bundgy cord 41 could be wrapped around set of drawers 14 rather than set of drawers 12.

Figure 4:
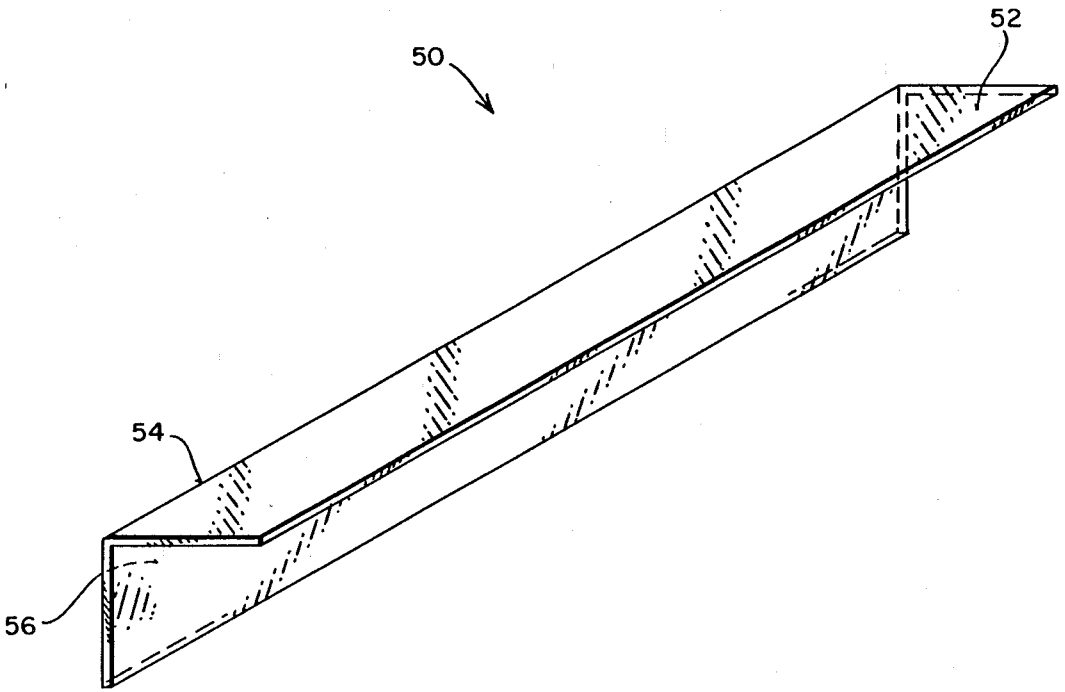
FIG. 4 is a pictorial view of an edge-protector.

FIG. 4 illustrates edge-protector 50. In a preferred embodiment of the present invention, edge-protector 50 is V-shaped. The "V" shape comes from the 90 degree angle between one side 52 and the other side 56 of edge-protector 50. Edge 54 separates the two sides 52 and 56 of edge-protector 50. Edge-protector 50 can be made of paperboard, cardboard, or plastic, for example. Handling instructions, identifying information, a company name, a logo, or special colors, for example, can be printed or written on the outer facing portions of sides 52 and 56 of edge-protector 50.

In a preferred embodiment of the present invention, edge-protector 50 is VBoard sold by Laminations company of Neenah, Wisconsin. Side 52 is 2.5 inches wide and side 56 is 2.5 inches wide. VBoard 50 is .225 inches thick Edge-protector 50 is precut into various lengths, the lengths depending on the length of the edges that are to be protected by the edge-protector. The edge-protectors are color-coded by assigning a different color to each different length of edge-protector. Color-coding helps in matching the proper-sized edge-protector to the proper edge of the desk the edge-protector is to protect.

Figure 5:
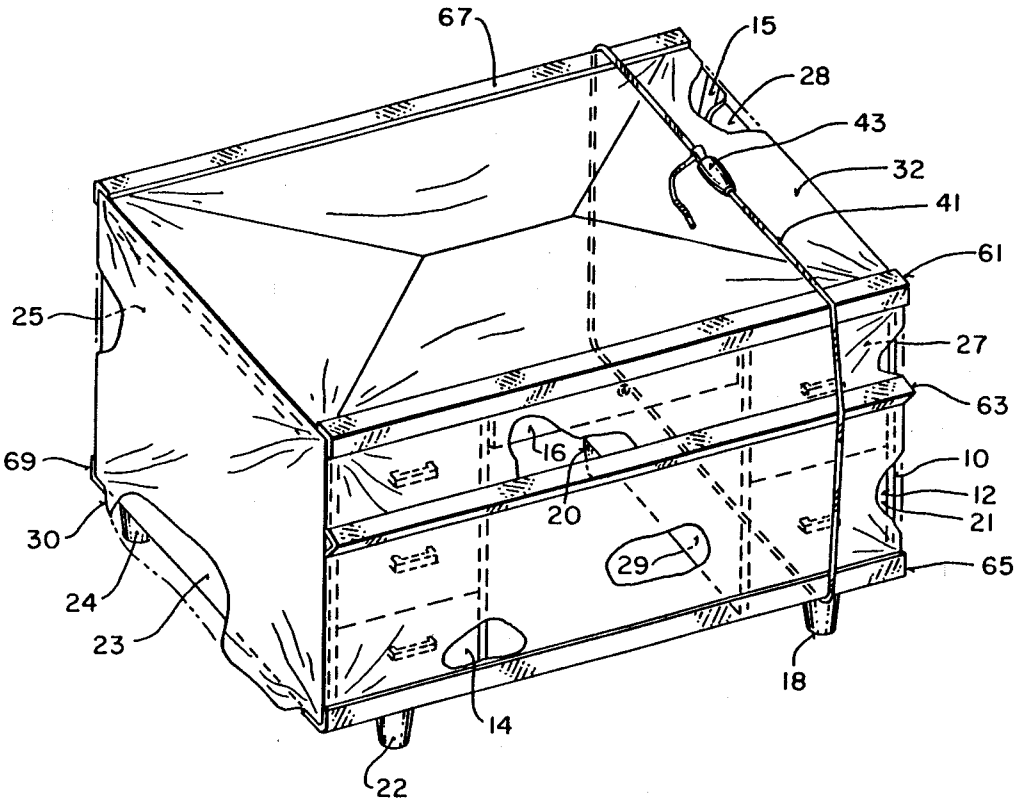
FIG. 5 is a pictorial view of a desk with front and rear horizontal edge-protectors placed under the cord and onto the edges of the desk residing under the cord.

FIG. 5 illustrates edge-protectors 61, 65, 69, and 67, placed on the horizontal edges of desk 10. Edge-protector 63 is placed across the middle of the front 21 of desk 10 and across left bank of drawers 14 and right bank of drawers 12. Edge-protectors 61, 63, 65, 69, and 67 are placed underneath bundgy cord 41. Edge-protector 63 does not reside on the edge of the desk, but instead is placed such that its extends away from the desk 10. Polyurethane bag 30 resides underneath edge-protectors 61, 63, 65, 69 and 67. In an alternative embodiment of the present invention, edge-protector 63 could be placed over one or more drawer handles of left bank of drawers 14 and right bank of drawers 12.

Edge-protectors 61, 65, 69, and 67 help to protect the horizontal edges of desk 10 from damage. Edge-protectors 61, 63, 65, 69, and 67 help to protect the entire desk from damage, especially when desks are stacked or placed next to each other. Edge-protectors 61, 63, 65, 69, and 67 are precut to the horizontal length of desk 10 before being placed on desk 10. Said edge-protectors are also color-coded to indicate that they are the horizontal edge-protectors. Said edge-protectors can also include information that identifies the type or style of desk or the name of the company that manufacturers the desk.

Figure 6:
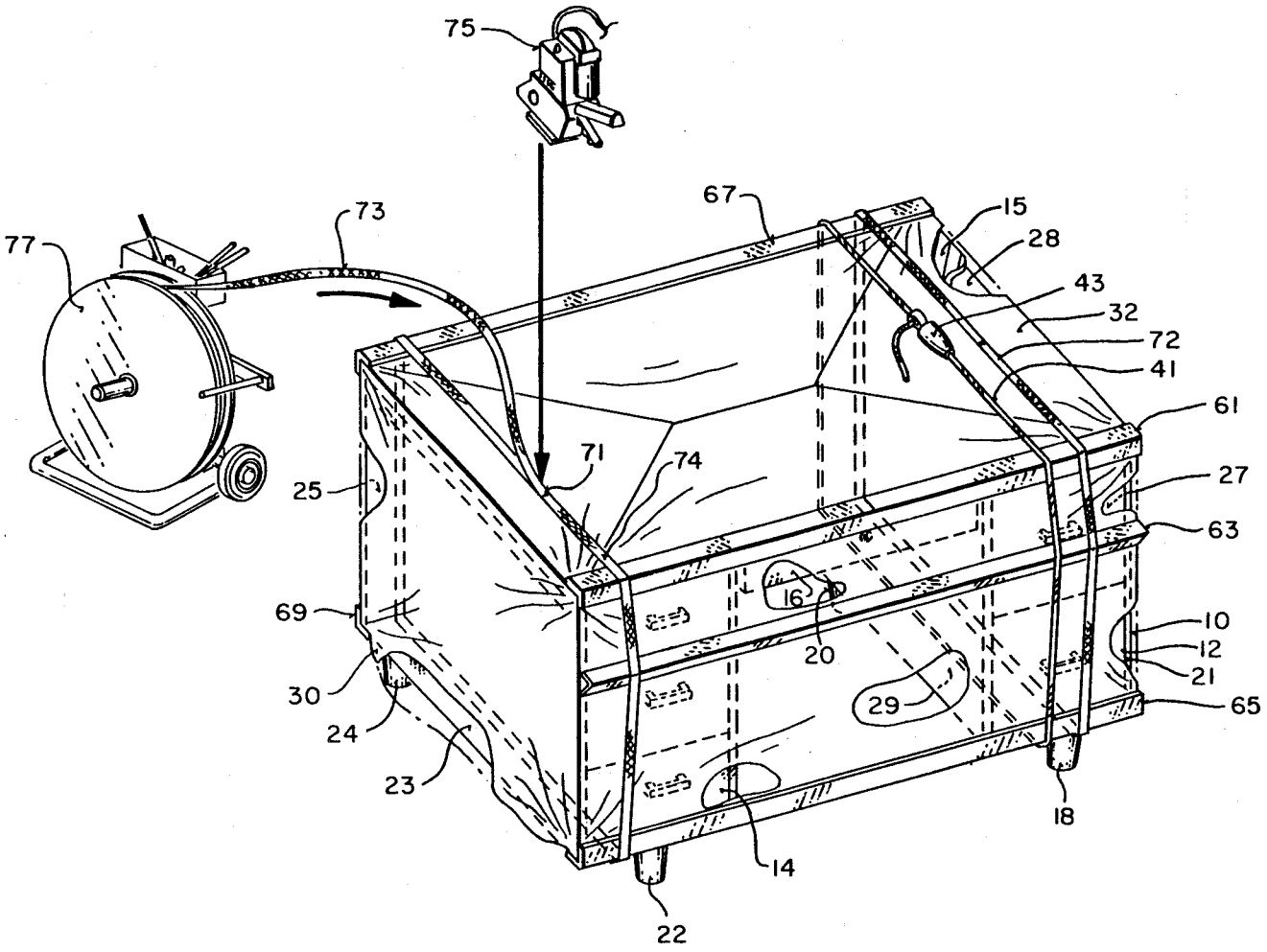
FIG. 6 is a pictorial view of a desk with straps placed around the front and rear horizontal edge-protectors and around the top, front, bottom and rear of the desk.

FIG. 6 illustrates desk 10 with plastic straps 72 and 74 placed around edge-protectors 61, 63, 65, 69, and 67 and around top 28, front 21, bottom 29, and rear 25 of desk 10. In a preferred embodiment of the present invention, straps 72 and 74 are each one-half inch width polypropylene plastic strap with a nominal break strength of 600 pounds. An example of such strap is Econoband strap supplied by Polychem Corporation of Mentor, Ohio.

Plastic straps 72 and 74 are tensioned and sealed with electric plastic strapping tool 75 to hold edge protectors 61, 63, 65, 69, and 67 in place. An example of electric plastic strapping tool 75 is the Fromm model P300. Plastic strap 72, for example, is first threaded into electric plastic strapping tool 75. The strap is then tensioned in the tool. The strap is then sealed by the tool. Excess strap is then removed from the tool. Electric strapping tool 75 seals the strapping by welding two pieces of the strapping together. The process is repeated for strap 74.

Plastic strap 72 is placed approximately 9 inches from right side 27 of desk 10. Plastic strap 74 is placed approximately 9 inches from left side 23 of desk 10. Straps 72 and 74 are supplied by strapping dispenser 77, which can have a core size of 16 inches by 6 inches, for example. As shown in FIG. 6, strap 73 runs from strap dispenser 77 to strap 74 and is sealed to strap 74 at point 71. Strap 73 is cut away from strap 74 after sealing through the use of strapping tool 75. Bundgy cord 41 is then removed from the desk by unclipping clip 43.

Figure 7:
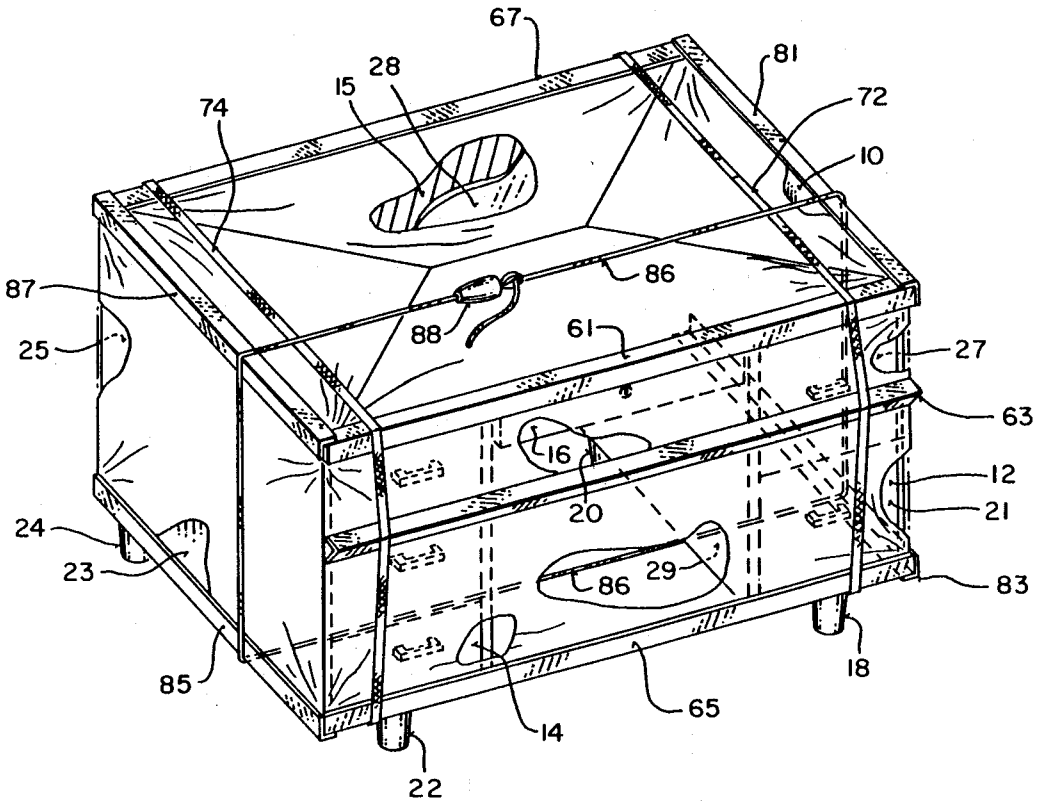
FIG. 7 is a pictorial view of a desk with a cord placed around the left side, top, right side, and bottom of the desk, and with side horizontal edge protectors placed under the cord and onto the edges of the desk residing under the cord.

FIG. 7 illustrates desk 10 with bundgy cord 86 wrapped around top 28, right side 27, bottom 29, and left side 23 of desk 10. Bundgy cord 86 is secured through the use of clip 88. Side horizontal edge-protectors 87, 85, 83 and 81 are placed under bundgy cord 86 and onto the edges of desk 10 residing under bundgy cord 86. Edge-protector 87 overlaps a portion of the ends of edge-protectors 61 and 67. Likewise, edge-protector 81 overlaps a portion of edge-protectors 67 and 61. Edge-protector 85 overlaps a portion of edge-protectors 65 and 69 (not shown in FIG. 7). Edge-protectors 83 overlaps a portion of the ends of edge-protectors 65 and 69 (not shown in FIG. 7). Edge-protectors 87, 85, 83, and 81 help protect the side horizontal edges of desk 10 from damage.

Figure 8:
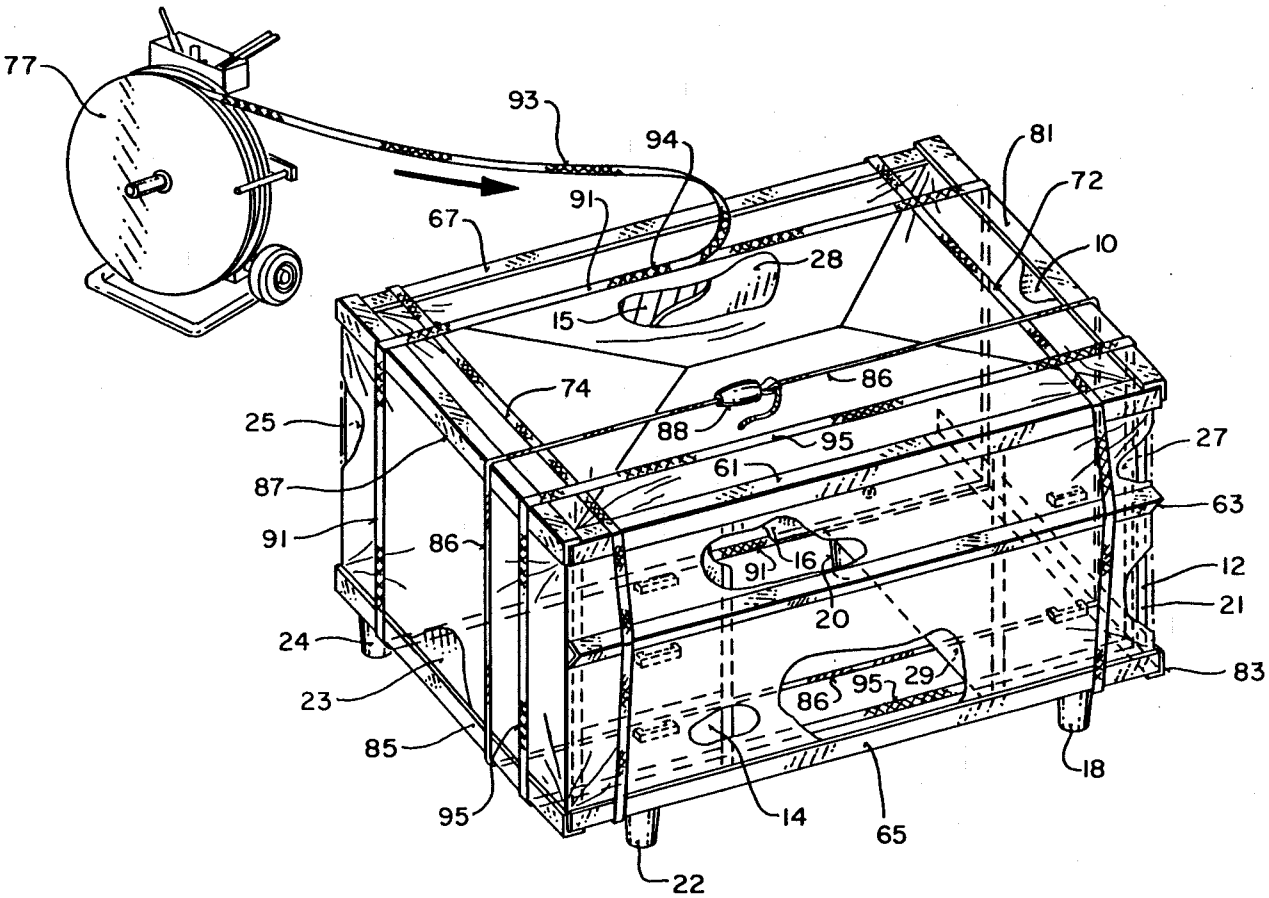
FIG. 8 is a pictorial view of a desk with straps placed around the side horizontal edge-protectors and around the left side, top, right side, and bottom of the desk.

FIG. 8 shows that side horizontal edge-protectors 87, 85, 83, and 81 are strapped in place through the use of straps 95 and 91. Strap 93 runs from strap dispenser 77 to strap 91 and is secured at point 94 by welding with an electric plastic strapping tool, such as the one described above with respect to FIG. 6. In FIG. 8, straps 95 and 91 are tensioned and welded in order to hold side horizontal edge-protectors 87, 85, 83, and 81 in place. Edge protectors 87, 85, 83, and 81 help to protect the side edges of desk 10 from damage. Bundgy cord 86 is then removed from desk 10 by unclipping clip 88.

FIG. 9 illustrates desk 10 with bundgy cord 104 wrapped around left side 23, rear 25, right side 27, and front 21 of desk 10 and attached with clip 108. Vertical edge-protectors 105, 103, 101, and 107 are placed on the vertical edges of desk 10 and underneath bundgy cord 104. Polyurethane bag 30 resides underneath vertical edge-protectors 105, 103, 101, and 107. The edges of front horizontal edge-protectors 63 residing at left side 23 and right side 27 of desk 10 are lifted slightly to allow vertical edge-protectors 107 and 101 to be installed underneath the outer edges of edge-protectors 63. Edge-protectors 105, 103, 101, and 107 provide edge-protection for the vertical edges of desk 10 and help protect desk 10 from damage. Vertical edge-protector 107 is placed over portions of edge-protectors 87, 85, 65, and 61. Vertical edge-protectors 105, 103, and 101 similarly cover portions of respective adjacent edge-protectors.

As shown in an exploded view in FIG. 9, precut edge-protector board 109 is placed between left set of drawers 14 and right set of drawers 12 and adjacent to bottom horizontal edge-protector 65. Edge-protector 109 is then taped with tape 102 to edge-protector 65 in order to hold edge-protector 109 in place. Tape 102 can either run through a cut in polyurethane bag 30 or else be taped to polyurethane bag 30. Edge-protector board 109 provides support for pedestals 12 and 14 and helps to keep pedestals 12 and 14 from bending if desk 10 is stacked. Edge-protector 109 also helps to strengthen edge-protector 65.

FIG. 10 illustrates desk 10 with plastic straps 121 and 123 wrapped around left side 23, rear 25, right side 27, and front 21, and around vertical edge-protectors 105, 103, 101, and 107 of desk 10. Plastic straps 121 and 123 are tensions and welded to hold vertical edge protectors 105, 103, 101, and 107 in place. Plastic strap 129 runs from plastic strap dispenser 77 to strap 123 and is welded or sealed at point 125 with a plastic strapping tool, as discussed above with respect to FIG. 6. Plastic strap 121 shown in FIG. 10 is placed approximately 6 inches from top 28 of desk 10. Plastic strap 123 is placed approximately 6 inches from bottom 29 of desk 10. Bundgy cord 104 is then removed from desk 10 by unclipping clip 108.

This completes the packaging of desk 10. Desk 10 is thus packaged in a way that allows most of desk 10 to be visible after packaging is completed. Thus, desk 10 can be inspected for color and size. The style of desk is also still readily apparent after packaging. Given that desk 10 is still substantially visible after packaging, a person inspecting packaged desk 10 can generally see if there is any damage to desk 10. This helps in assessing damage of desk during shipment. Persons would also be more likely to know at what stage of shipment any damage occurred given that the desk is substantially visible as it is shipped.

The method of packaging desk 10 described above can be performed by one or two persons on the production line without the use of a separate holding area, resulting in savings of space, time, labor, and money. In an alternative embodiment of the present invention, the method of packaging described above can be automated and performed by robots or other machinery.

A packaged desk 10 is only slightly larger than a desk 10 that has not been packaged. Therefore, more packaged desk can be stored or stacked in a given volume.

The materials described above that are used in the packaging method --for example, corrugated pad 15, polyurethane bag 30, and the edge-protectors -- take up a relatively small amount of space for each desk to be packaged. Each desk does not require much packaging material.

Packaging according to the above steps also results in less damage during unpacking. To remove desk 10 from its package, each leading edge of straps 91, 95, 74, 72,

121 and 123 is pulled, breaking the weld on each strap. Each strap then pops off. Alternatively, the straps can be cut with scissors. Each of the edge protectors 61, 67, 69, 65, 63, 87, 81, 83, 85, 105, 103, 101, and 107 then falls to the floor. Polyurethane bag 30 is then removed from desk 10 by lifting it off desk 10. Corrugated pad 15 is then removed from desk 10 by lifting pad 15 off desk 10.

A single pedestal desk having a single set of drawers could alternatively be packaged according to the method of the present invention.

In the foregoing specification, the invention has been described with reference to specific exemplary embodiment thereof. It will, however, be evident that various modifications and changes may be made thereto without departing from the broader spirit and scope of the invention as set forth in the appended claims. The specifications and drawings are, accordingly, to be regarded in an illustrative rather than a restrictive sense.

What is claimed is:

1. A method for packaging a desk having top, bottom, front, back, left side, and right side, comprising the steps of:

covering the top, front, back, left side, and right side of the desk with covering means;

placing a first flexible securing means around the top, front, bottom, and rear of the desk;

placing a plurality of front and rear horizontal edge-protecting means under the securing means and onto the edges of the desk residing under the securing means;

strapping the plurality of front and rear horizontal edge-protecting means in place by strapping around the front and rear horizontal edge-protecting means and around the top, front, bottom, and rear of the desk;

placing a second flexible securing means around the left side, top, right side, and bottom of the desk;

placing a plurality of side horziontal edge-protecting means under the securing means and onto the edges of the desk residing under the securing means;

strapping the plurality of side horizontal edge-protecting means in place by strapping around the side horizontal edge-protecting means and around the left side, top, right side, and bottom of the desk;

placing a third flexible securing means around the left side, front, right side, and back of the desk;

placing a plurality of vertical edge-protecting means under the securing means and onto the edges of the desk residing under the securing means; and strapping the plurality of vertical edge-protecting means in place by strapping around the vertical edge-protecting means and around the left side, front, right side, and back of the desk.

2. The method of claim 1 for packaging a desk, wherein each of the first, second, and third flexible securing means comprises a cord.

3. The method of claim 1 for packaging a desk, wherein the covering means comprises a plastic bag.

4. The method of claim 1 for packaging a desk, wherein each of the edge-protecting means comprises a V-shaped cardboard strip.

5. The method of claim 1 for packaging a desk, further comprising the step of covering the top of the desk with a corrugated pad.

6. The method of claim 1 for packaging a desk, further comprising the step of inserting support means between a set of left drawers and a set of right drawers of the desk.

7. The method of claim 6 for packaging a desk, wherein the support means comprises a V-shaped cardboard strip.

8. The method of claim 1 for packaging a desk, comprising the additional steps of:

removing the first flexible securing means after strapping the front and rear horizontal edge-protecting means;

removing the second flexible securing means after strapping the side horizontal edge-protecting means; and removing the third flexible securing means after strapping the vertical edge-protecting means.

* * * * *

UNITED STATES PATENT AND TRADEMARK OFFICE

CERTIFICATE OF CORRECTION

PATENT NO. : 4,878,334

DATED : November 7, 1989

INVENTOR(S) : Daniel M. Quinn

It is certified that error appears in the above-identified patent and that said Letters Patent is hereby corrected as shown below:

| COLUMN | LINES(S) | |
|---|---|---|
| 01 | 18 | delete "disk" insert --desk-- |
| 02 | 51 | delete "botton" insert --bottom-- |
| 03 | 48 | delete "botom" insert --bottom-- |
| 03 | 63 | delete "desk 30" insert --desk 10-- |
| 04 | 06,12,13, 16,17,20, 22,23,25, 55. | delete "bundgy" insert --bungee-- |
| 04 | 08,11,19 | delete "Bundgy" insert --Bungee-- |
| 05 | 36,40,41, 62,66. | delete "bundgy" insert --bungee-- |
| 05 | 34,38,60 | delete "Bundgy" insert --Bungee-- |
| 06 | 36 | delete "Bundgy" insert --Bungee-- |

Signed and Sealed this

Ninth Day of July, 1991

*Attest:*

HARRY F. MANBECK, JR.

*Attesting Officer*

*Commissioner of Patents and Trademarks*